US005265675A

United States Patent [19]

Hearn et al.

[11] Patent Number: 5,265,675

[45] Date of Patent: Nov. 30, 1993

[54] WELL CONDUIT CUTTING AND MILLING APPARATUS AND METHOD

[75] Inventors: David D. Hearn, Anchorage, Ak.; Charles M. Hightower, Plano, Tex.; Stephen L. Ward, Anchorage, Ak.; Charles D. Hailey, 11628 Burning Oak Rd., Oklahoma City, Okla. 73150

[73] Assignees: Atlantic Richfield Company, Los Angeles, Calif.; Charles D. Hailey, Oklahoma City, Okla.; a part interest

[21] Appl. No.: 857,212

[22] Filed: Mar. 25, 1992

[51] Int. Cl.[5] ..... E21B 29/00

[52] U.S. Cl. ..... 166/297; 166/55.1; 166/55.8

[58] Field of Search ..... 166/298, 297, 55.7, 166/55.8, 55.1, 55.6, 55

[56] References Cited

U.S. PATENT DOCUMENTS

| | | | |
|---|---|---|---|
| 3,489,211 | 1/1970 | Kammerer, Jr. | 166/55.8 |
| 4,585,061 | 4/1986 | Lyons, Jr. et al. | 166/77 |
| 4,646,826 | 3/1987 | Bailey et al. | 166/55.8 X |
| 4,776,394 | 10/1988 | Lynde et al. | 166/55.8 |
| 4,809,793 | 3/1989 | Hailey | 166/312 X |
| 5,150,755 | 9/1992 | Cassel et al. | 166/55.6 X |

*Primary Examiner*—Terry L. Melius
*Attorney, Agent, or Firm*—Michael E. Martin

[57] ABSTRACT

A well conduit cutting and milling apparatus conveyable into and out of a well on coilable tubing using a tubing injection unit. The apparatus includes tubing or casing cutting arms which are radially extendable and retractable with respect to a cylindrical support body by pressure fluid operated pistons. The apparatus is made up of multiple end-to-end connected units including one which supports interchangeable cutting and milling arms and units which have radially extensible and retractable stabilizing arms which engage the inner wall of the tubing or casing to centralize and stabilize the apparatus during operation. The cutter and milling arms are modified for milling away a section of tubing by moving the apparatus in an upward or out of the well direction. The cutting elements are preferably cylindrical hard metal members which are supported on the arms for cutting away an end face of the tubing in a tangential direction of movement.

9 Claims, 3 Drawing Sheets

WELL CONDUIT CUTTING AND MILLING APPARATUS AND METHOD

BACKGROUND OF THE INVENTION

1. Field of the Invention

The present invention pertains to a well conduit (tubing and/or casing) cutting and milling apparatus and method for insertion in a wellbore to cut through a tubing or casing section and to mill out a predetermined length of tubing or casing.

2. Background

In subterranean well operations, it is occasionally necessary to cut and remove a section of a tubing string or well casing. To this end, several configurations of tubing or casing cutting and milling tools have been developed for use with conventional drill rigs which must be brought on site over the well head. However, the cost and time consumed in using conventional rigs is disadvantageous and there has been a significant increase in the use of so-called coiled tubing units for certain well operations.

Basically, known prior art types of cutting and milling tools for use with conventional drill rigs are configured for cutting through a tubing or casing section and then mill away a portion of that section by moving the tool in a generally downward direction. The operation of these types of tools has several shortcomings when attempted to be used with coiled tubing. Control over the axial downward pressure on the tool is usually difficult to maintain because of the flexibility of the tubing string to which the tool is connected. Accordingly, the cutting or milling tool may wear prematurely and the downward pressure may also deflect the casing or tubing being cut resulting in failure of the tool and/or the tubing or jamming of the tool in the casing or tubing.

Known types of casing, cutting and milling tools are also not adapted to being inserted into the casing string through smaller diameter tubing strings. Known types of tools require removal of the tubing string from the wellbore before the tool can be inserted and operated to cut and mill away a section of casing.

Still further, known types of tools are difficult to operate when cutting and milling tubing since, in many instances, the tubing string may be forced "off center" with respect to the central axis of a casing or larger diameter tubing string in which the tubing string to be cut and milled is located. Still further, known types of cutting and milling tools are sometimes unduly complicated, are otherwise difficult to use, particularly when replacement of the cutter or milling members is required.

SUMMARY OF THE INVENTION

The present invention provides an improved well conduit cutting and milling apparatus, particularly adapted for insertion into a well tubing or casing string for cutting through the wall of the tubing or casing string and then removing a section of the tubing or casing string by milling.

In accordance with one important aspect of the present invention, a tubing or casing cutting apparatus is provided wherein a pair of opposed cutter arms are pivotally supported on a tool body for movement between retracted positions for insertion in and removal from the tubing string and a working position for cutting through the circular wall of a tubing or casing string. The wall cutting elements may be used to perform milling operations or may be easily replaced by a set of arms which include a configuration of milling cutter elements which more rapidly and efficiently mill away a section of the conduit.

In accordance with another important aspect of the present invention there is provided a milling apparatus which is operable to mill away a section of tubing or casing by moving the apparatus in a generally upward direction during the milling operation.

In accordance with still a further important aspect of the present invention, a well conduit cutting and milling apparatus is provided which includes unique stabilizer or bearing members for centralizing the apparatus in the wellbore and for supporting the conduit cutter and milling elements during the respective operations of the apparatus.

In accordance with yet a further aspect of the present invention, there is provided a well conduit cutting and milling apparatus having a unique arrangement of cutter support arms and cutter elements. The cutter elements, which may be used in different arrangements as milling cutters, are supported on unique milling support arms which minimize the production of elongated metal chips or cuttings to thereby enhance the removal of the milling cuttings from the wellbore.

The present invention yet further provides a casing, cutting and milling tool which may be inserted into a wellbore through a tubing string of smaller diameter than the casing and, upon emerging from the bottom of the tubing string or a cut away section of tubing string, operated to cut and mill away a section of casing.

In accordance with still a further important aspect of the present invention, there is provided a unique method for cutting and milling out a section of well tubing string in a wellbore and then cutting and milling out a section of casing in a wellbore, both operations being carried out using coiled tubing to convey the cutting and milling tool in and out of the wellbore, and without removing the entire well tubing string from the wellbore above the point of cutting of the well casing.

Those skilled in the art will recognize the above described advantages and features of the present invention together with other superior aspects thereof upon reading the detailed description which follows in conjunction with the drawings.

DESCRIPTION OF PREFERRED EMBODIMENTS

Figure 1:
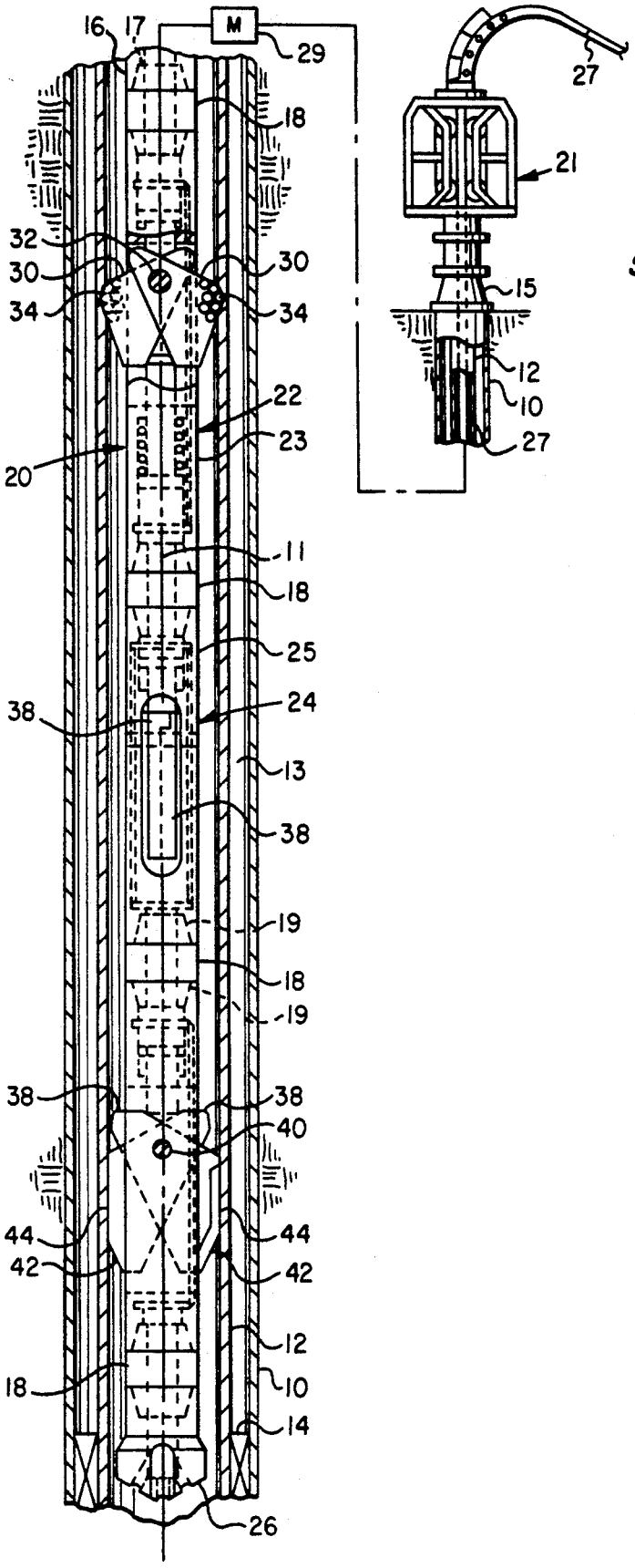
FIG. 1 is a central longitudinal section of a wellbore showing the tubing and casing cutting and milling apparatus of the present invention disposed therein.

In the description which follows, like parts are marked throughout the specification and drawing with the same reference numerals, respectively. The drawing figures are not necessarily to scale in the interest of clarity and conciseness.

Referring to FIG. 1, there is illustrated a wellbore casing 10 in which is concentrically disposed a tubing string 12 which is secured to the casing at one point, at least, by a conventional packer 14. The casing 10 and tubing string 12 extend to a conventional surface wellhead 15. In many wellbore operations, it is desirable to be able to remove a section of tubing and/or casing for various reasons, including the initiation of "side-tracking" or drilling a deviated hole out of the side of the casing at a predetermined point. These operations are desirably carried out without removing the tubing string from the casing or, of course, removing the casing from the wellbore. For the sake of this discussion, it is to be assumed that a section of the tubing string 12 is to be removed so that a side-tracking operation may be initiated.

Modern well operations equipment include so-called coiled tubing injection units wherein a reel of coiled metal tubing may be dereeled and injected into a tubing string to convey fluids and/or certain tools or devices into the wellbore to a predetermined point. The apparatus of the present invention is adapted to be used in conjunction with such coilable tubing strings, including a tubing string which has attached to its lower end a rotary motor or the like 29, having a rotatable output shaft or drive sub 16. The motor 29 may be a positive displacement rotary motor of conventional "downhole" motor design or of the type mentioned in U.S. Pat. No. 4,809,793 to Charles D. Hailey. The shaft 16 is threadably connected to an adapter part 18, having opposed threaded "pin" portions 19. The adapter part 18 is connected to an elongated apparatus, generally designated by the numeral 20, for performing tubing cutting and milling operations for removing a section of the tubing 12, for example. The apparatus 20 may, of course, also be connected to the lower end of a tubing string which is rotated at the surface by a suitable mechanism including a conventional rotary table, not shown.

The motor output shaft 16, which, as indicated above, may also be the distal end of a tubing string, has an internal passage 17 formed therein for conveying pressure fluid to the apparatus 20 by way of the adaptor part 18. The fluid conveyed to the apparatus 20 may comprise a mixture of diesel fuel, or water or drilling fluids and certain additives or weighting agents which may be useful otherwise in the wellbore and may be used to convey cuttings from the tubing cutting and milling operation upward through the wellbore, by way of the annular passage 13 formed between the casing 10 and the tubing 12. The method of circulating fluid out of the wellbore, the provision of a suitable rotary drive motor 29, or driving the apparatus 20 by a conventional rotatable tubing string are believed to be within the purview of one skilled in the art of wellbore conduit cutting and milling tools and will not be discussed in greater detail herein in the interest of clarity and conciseness. However, an important aspect of the present invention resides in providing the apparatus 20 to be particularly useful with a coiled tubing injection unit 21, such as a type manufactured by Hydra-Rig, Inc., Fort Worth, Tex., and described in detail in U.S. Pat. No. 4,585,061 to Lyons, Jr., et al. The injection unit 21 is adapted to inject coilable tubing 27 into and out of the tubing string 12. The tubing 27 is operably connected at its lower or distal end to motor 29, FIG. 1.

The apparatus 20 includes a conduit cutting and milling unit, generally designated by the numeral 22, which is suitably threadably coupled to the adapter part 18 for rotation therewith. The unit 22 is also suitably connected to a stabilizer or bearing support unit 24 by an adapter part 18. The adapter parts 18 each have a suitable internal passage formed therein for conveying fluid to the unit 22 and from the unit 22 to the unit 24 for purposes to be described herein.

Referring further to FIG. 1, the apparatus 20 includes a second stabilizer unit 24 threadably coupled to the first unit 24 by way of one of the adapters 18. Still further, the apparatus 20 may include a conventional rotary drill bit 26 coupled to the lower one of the units 24 also by way of one of the adapters 18.

In the configuration of the apparatus 20 illustrated in FIG. 1, the cutting and milling unit 22 includes a generally cylindrical body member 23 which is fitted with a pair of pivotally extensible cutting element support arms 30 which are supported on pivot means 32 for opposed pivotal movement between a retracted position, not shown, and a position for cutting through the tubing 12. Each of the arms 30 is provided with a plurality of small, generally cylindrical metal cutting elements 34 mounted on the radial extremities of the arms, as illustrated, for cutting through the tubing 12 upon rotation of the apparatus 20 about the central longitudinal axis 11 of the casing 10. The configuration of the cutting elements 34 will be further described hereinbelow.

Each of the stabilizer units 24 is characterized by a generally cylindrical body 25 on which is pivotally supported a pair of opposed bearing arms 38 operable to move between retracted and extended positions about pivot means 40. Each of the arms 38 includes at least one bearing surface 42 for engagement with the inner wall of the casing 10, such as during the milling operation illustrated in FIG. 2. In addition, the arms 38 also preferably include suitable bearing surfaces 44 which are engageable with the inside wall of the tubing 12 during cutting and milling operations to also stabilize and centralize the apparatus 20 within the tubing during the cutting and milling operations. Usually, the arms 38 of one of the stabilizer units 24 are oriented to extend and retract in a plane which is normal to the plane of extension and retraction of the other set of arms on the other stabilizer unit 24. For example, as illustrated in FIG. 1, the uppermost stabilizer unit 24 has a set of arms 38 which move in a plane extending normal to the paper of drawing FIG. 1 and also, of course, normal to the plane of movement of the arms of the lower stabilizer unit 24.

Once the tubing 12 has been cut completely through and at least a small section of tubing has been milled away by the elements 34 on the support arms 30, the apparatus 20 is preferably removed from the tubing string 12 and the arms 30 are replaced by a set of milling cutter arms to be described hereinbelow which will mill the tubing 12 more rapidly and efficiently than is provided for by the configuration of the arms 30. However, the arms 30 may be used to mill away a substantial amount of the tubing 12 without being replaced by the aforementioned milling cutter arms.

Figure 2:
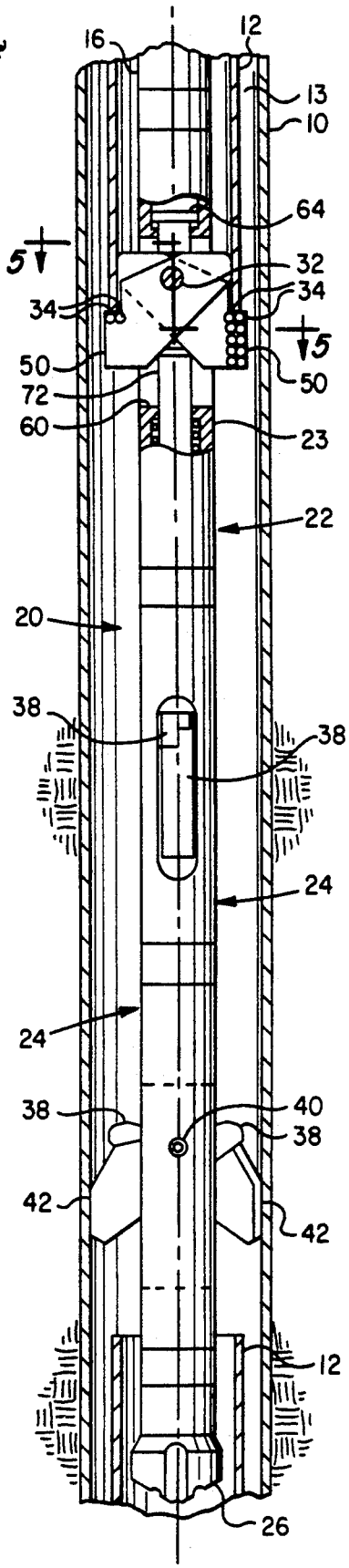
FIG. 2 is a view similar to FIG. 1 showing the apparatus milling away a section of well tubing.

Referring now to FIG. 2, the apparatus 20 is illustrated disposed in the casing 10 wherein a substantial portion of the tubing 12 has already been milled away as the apparatus 20 is pulled generally upwardly in the casing, viewing FIGS. 1 and 2. In FIG. 2, the cutting and milling unit 22 is shown with a pair of milling cutter arms 50 pivotally supported by the pivot 32 and movable between a retracted position, not shown, and the radially extended position shown whereby a plurality of cutting elements 34 mounted on the radial extremities of the arms 50 are in position for milling the end face 51 of the tubing 12 above a portion of the tubing which has already been removed by such milling. In the arrangement illustrated in FIG. 2, the stabilizer arms 38 have also moved radially outwardly so that the bearing surfaces 42 engage the inside wall of the casing 10 to centralize and stabilize the apparatus 20 during the milling operation.

Figure 3:
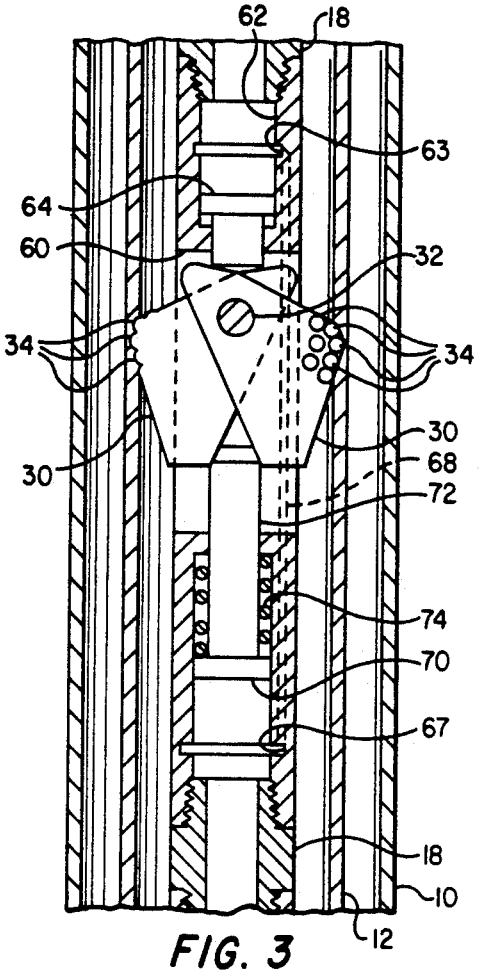
FIG. 3 is a central longitudinal section view of the cutting and milling unit of the apparatus.
Figure 5:
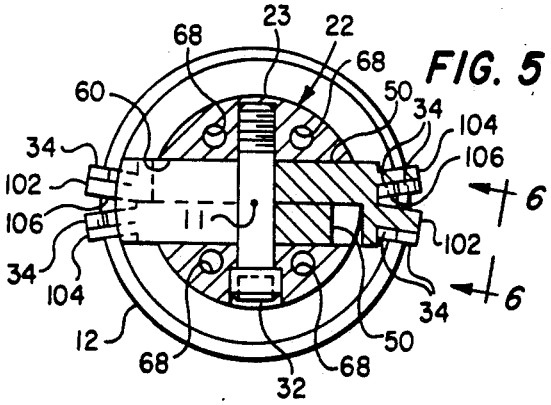
FIG. 5 is a section view taken generally along the line 5—5 of FIG. 2.

Referring now to FIG. 3, the cutting and milling unit 22 is shown in vertical longitudinal central section. The body member 23 is provided with suitable threaded "box" ends for coupling to the adapters 18. The body 23 also includes a generally central longitudinally extending slot 60 formed therein for receiving the arms 30 or 50, respectively. Referring briefly to FIG. 5, the pivot means 32 may comprise a threaded socket head type bolt, as illustrated, which is easily removable to interchange the arms 30 with the arms 50.

The body 23 further includes a central bore 62 in which is disposed a piston actuator 64 for moving the arms 30 from their retracted position to their radially extended position illustrated in FIGS. 1 and 3. The body 23 also includes a second bore 66 which opens to the opposite end of the body 23 and is aligned with the bore 62. Annular groves 63 and 67 open into the bores 62 and 66 and are interconnected by elongated passages 68 which extend through the body 23 and form fluid flow paths between the bores 62 and 66. A second piston 70 is disposed in the bore 66 and has a reduced diameter portion 72 which extends into the slot 60 and is engageable with the arms 30 to urge the arms into their radially extended positions and to aid in holding the arms in a position so that the cutting elements 34 may cut the tubing 12. The piston 70 is biased to retract into the bore 66 by resilient means such as a coil spring 74.

In operation of the cutting and milling unit 22, the pistons 64 and 70 are initially retracted so that the arms 30 may pivot into a retracted position substantially within the slot 60 and such that the arms do not protrude substantially radially from the body 23. In this way the apparatus 20 may be lowered through tubing strings having certain restrictions therein which are only slightly greater in diameter than the diameter of the body 23. Once the apparatus 20 is placed in position to actuate the units 22 and 24, pressure fluid acting against the face 65 of the piston 64 urges that piston to pivot the arms 30 into the extended positions illustrated in FIGS. 1 and 3. Pressure fluid is also conducted from the bore 62 by way of groove 63, passages 68 and groove 67 into the bore 66 to urge the piston 70 into the position shown to engage the arms 30 and hold them in their radially extended positions. Since the bore 66 opens to the lower end face of the body 23, pressure fluid may also be conducted through the adapters 18 into the units 24 to effect operation of their bearing arms to move into their radially extended stabilizing and supporting positions for the apparatus 20. The basic mechanism for extending and retracting the arms 30, 50 and 42 for the respective units 22 and 24, is similar to the mechanism described in U.S. Pat. No. 4,809,793 to Charles D. Hailey. The unit 22 may be made of suitable engineering materials used for downhole tools. The material used for the cutting elements 34 will be described further herein.

Figure 4:
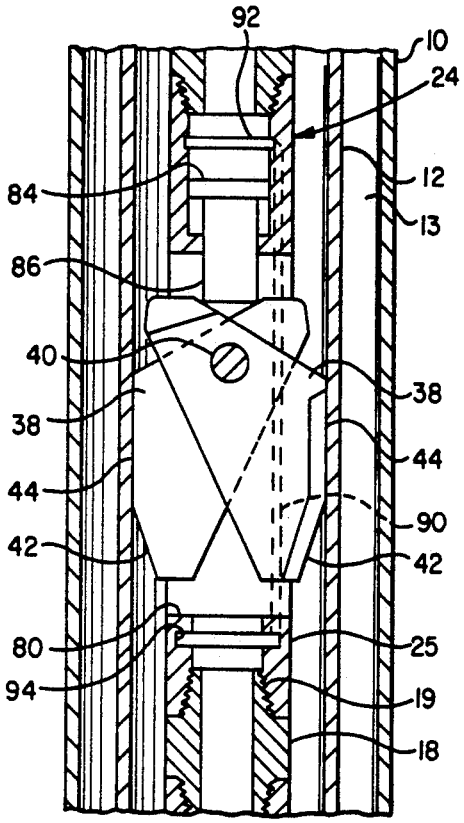
FIG. 4 is a central longitudinal section view of one of the stabilizer units of the apparatus.

Referring now to FIG. 4, one of the units 24 is illustrated in central longitudinal section and is characterized by the generally cylindrically elongated body 25, preferably of about the same diameter as the body 23 and which also has a centrally disposed, elongated slot 80 formed therein for housing the opposed bearing arms 38. The body 25 also includes an upper, central, axial bore 82 in which a piston 84 is disposed for movement such that a reduced diameter portion 86 of the piston which extends into the slot 80 is operable to pivot the arms 38 from a retracted position to an extended position to stabilize the apparatus 20 in the tubing 12 and, upon cutting away a sufficient portion of the tubing 12, to further extend the arms 38 radially so that the bearing surfaces 42 engage the inner wall of the casing 12, as shown in FIG. 2. The body 25 also includes a central passage 88 extending from the end opposite the end which includes the bore 82 and which is in communication with the bore 82 by one or more axially extending passages 90 formed in the body. The passages 90 are preferably in communication with annular grooves 92 and 94 which are in communication with the bores 82 and the passage 88, respectively, so that pressure fluid may flow into the bore 82 and through the body 25 to exit the unit 24 and pass on to another of the units 24 or to exhaust passages formed in the bit 26 so that spent pressure fluid ma enter the wellbore to evacuate cuttings and other debris within the tubing string 12 or the casing 10, as the case may be.

Referring again briefly to FIG. 3, the cutter arms 30 are configured such that a plurality of the cutting elements 34 are suitably supported thereon near the radial extremities of the arms so that as the arms are extended radially with respect to the axis 11, the cutting elements 34 will engage the wall of the tubing 12 and begin cutting or milling away the tube material. The cutting elements 34 are arranged on the extremities of the arms 50 such that, as the tubing 12 is completely cut through and upward pressure is exerted on the apparatus 20 while it is rotated, a certain amount of milling of the tubing will take place, at least sufficient to provide a space for extension of the arms 50 into their working positions as shown in FIG. 2 after these arms have been exchanged for the arms 30 on the unit 22. The arms 30 and 50 are preferably manufactured of mild steel plate and the cutting elements 34 are typically made of silicon or tungsten carbide and are secured to the arms 30 and 50 by conventional braze metal or the like, as shown in FIG. 6 by way of example.

Figure 6:
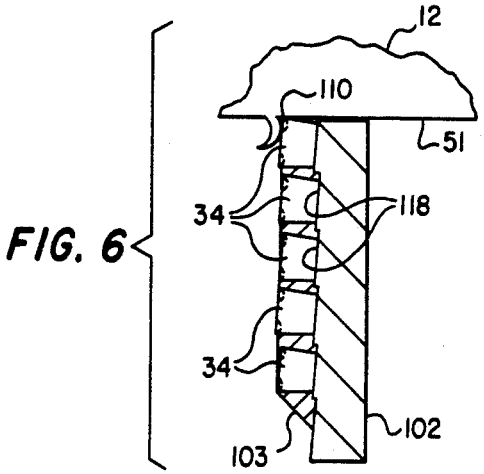
FIG. 6 is a view taken generally from the line 6—6 of FIG. 5.

Referring now to FIGS. 5 and 6, the milling arms 50 are each provided with radially projecting cutter support plates 102 and 104, respectively. The support plate 102 is preferably approximately twice the thickness of the support plate 104. A generally wedged-shaped space 106 is provided between the support plates 102 and 104, respectively. Cutting elements 34 are mounted by braze metal 103, for example, on each of the support plates 102 and 104 and are preferably arranged in at least two radially-spaced rows of cutting elements. Three or more rows of cutting elements 34 on each support plate 102 and 104 may be preferable. The cutting elements 34 in each row are staggered with respect to the cutting elements in the adjacent row to facilitate the cutting action on the end face of the tubing.

Figure 7:
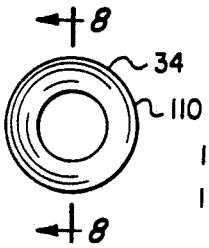
FIG. 7 is front elevation of one of the cutting or milling elements.
Figure 8:
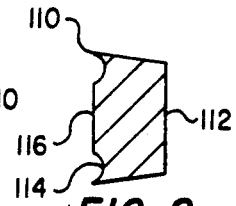
FIG. 8 is a section view taken along the line 8—8 of FIG. 7.

Referring primarily to FIGS. 6, 7 and 8, each of the cutting elements 34 is preferably a generally frustoconical member having a generally cylindrical cutting edge 110, a support face 112 and a generally annular chip breaking relief or recess portion 114 formed in the face 116. An axial taper between the faces 112 and 116 is preferably on the order of about 7 degrees to form a frustoconical shape to the cutting elements. Each of the cutting elements 34 is mounted on the support plate 102, for example, by brazing the base 112 to staggered support surfaces 118 to accentuate the degree of relief of the cutting edge 110 with respect to the surface 51 of the tubing to be cut as indicated in FIG. 6. Furthermore, the faces 116 of the cutting elements 34 should also lie in planes which intersect the axis of rotation 11 so that, as the cutting elements rotate about the axis 11 to cut the surface or face 51 of the tubing 12, the cutting edge 110 is moving in a substantially tangential direction with respect to the tubing face. As mentioned above, the support arms 50 are also preferably made of mild steel so that the plate portions 102 and 104 will wear away to continually expose cutting edges 110 on the cutting elements 34 as the tubing is milled by the apparatus 20. A unique advantage of the milling cutter arrangement provided on the arms 50 is that, with the support plate 102 being approximately twice as thick as the support plate 104 and forming the space 106 therebetween, the cutting action tends to produce chips which are relatively short and are not continuously curled indefinite lengths of cuttings. In this way, the cuttings are more easily removed from the wellbore and the wellbore passage 13 does not tend to become clogged by entangled and intertwined long metal chips.

The operation of the apparatus 20 is believed to be easily understood from the foregoing description. However, briefly, the apparatus 20 may be operated by being extended into a well conduit such as the tubing 12 or the casing 10 operably connected to the distal end of tubing string 27 and wherein motor 29 is interconnected between the tubing string and the apparatus 20, for example. Preferably, the motor 29 is pressure fluid operated and fluid exhausted from the motor is used to actuate the arms 30 and/or 50 and the arms 38 of the stabilizer units 24. When the apparatus 20 is prepared for insertion in a wellbore, the pistons 64, 70 and 84 are in a retracted position to permit folding of the arms 30 or 50 into the slot 60 and folding of the arms 38 into the slots 80, respectively. When the apparatus 20 is positioned in the wellbore at the prescribed location, pressure fluid is applied through the tubing 27, motor 29 and the passage 17 to actuate the pistons 64 and 70 to extend the cutter arms 30 into a position to engage the wall of the tubing 12. Pressure fluid is also conducted through the units 22 and 24 to effect actuation of the pistons 84 to extend the arms 38. The preassembly of the stabilizer units 24 is such as to place the respective sets of stabilizer arms 38 in planes which are normal to each other.

Upon actuation of the cutter arms 30 into the cutting position shown in FIG. 1 and movement of the bearing or stabilizer arms outward to engage the inner wall of the tubing 12, the apparatus is rotated to effect cutting through the tubing 12 at the point of engagement of the cutting elements 34 therewith. Once the tubing 12 is cut through upward force is urged on the apparatus 20 to begin milling away enough of the tubing 12 to provide room for extension of the arms 50 into their position for high speed milling of the tubing once they are employed. Once the tubing has been cut through and a sufficient portion milled away to permit use of the arms 50, the apparatus 20 is withdrawn from the wellbore. Prior to withdrawal, pressure fluid is relieved from acting on the apparatus 20 and the piston 70, in particular, is biased back away from engagement with the arms 30 so that they may fold back into the slot 60. In like manner, the stabilizer arms 38 also retract into their slots 80.

The cutter arms 30 are replaced by the milling arms 50 and the apparatus is reinserted into the wellbore as per the initial procedure. When the apparatus 20 is positioned to permit extension of the arms 50 into their milling positions shown in FIGS. 2 and 5, fluid pressure is again applied to the apparatus 20 to extend the arms 50 and 38 so that if one set of arms 38 is still disposed in the tubing 12 as the milling progresses and the unit 24 moves into the casing 10, these arms will automatically further extend to engage the bearing surfaces 42 with the casing inner wall to stabilize and centralize the apparatus 20 in the casing. Continued upward force on the unit 20 exerted by the tubing string 27 through the coiled tubing injection unit 21, while supplying pressure fluid to the apparatus 20, will effect rapid milling away of the tubing 12 until the operation is complete. A substantial and finely controllable upward force can be exerted on the apparatus 20 by the tubing 27 thanks to the injection unit 21. Pressure fluid is then again relieved from acting on the pistons 64, 70 and 84 so that the arms of the units 22 and 24 may retract to positions which will permit withdrawal of the apparatus 20 from the wellbore.

Figure 9:
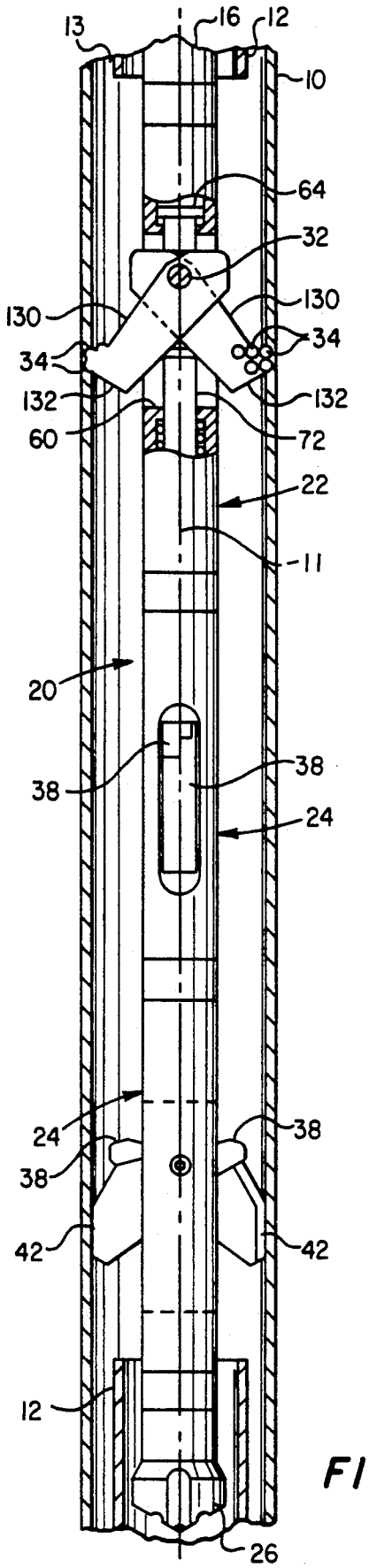
FIG. 9 is a longitudinal central section view, similar to FIG. 1, showing the apparatus cutting a section of casing.

Referring now to FIG. 9, the apparatus 20 is shown in place within the casing 10 operating to cut through the casing, as indicated, in the area where the section of tubing 12 has been removed. Prior to operating the apparatus 20 to perform the casing cutting and milling operation, the apparatus is removed from the wellbore through the tubing string 12 and the cutter arms 30 or 50 are removed and replaced by a pair of opposed pivotable arms 130 which are supported on the unit 22 for pivotal movement about the axis of the pivot 32 from a retracted position substantially within the slot 60 to the extended working position illustrated. Each of the arms 130 is provided with a plurality of cutting elements 34 supported on the radial extremities of the arms 132, respectively, so that upon rotation of the apparatus 20, the cutting elements 34 will operate to cut through the casing 10. Moreover, once the cutting elements 34 have cut through the casing 10 the arms 130 may be slightly further radially extended so that the cutting elements may begin milling away a portion of the casing using generally the upward movement of the apparatus 20 with respect to the casing in a manner similar to the milling operation carried out to mill away the section of tubing 12. The arms 130 are moved between their retracted positions and extended positions by the pistons 64 and 70 in the same manner as the arms 30 or 50. Although the stabilizer units 24 are shown mounted below the cutting unit 22 in FIG. 9 it may be desirable to place one or both stabilizer units above the cutting unit in the assembly so that the stabilizer arms 38 bear against uncut portions of the casing throughout the milling operation.

Accordingly, the apparatus 20 may be used to perform a unique casing removal operation wherein the apparatus may be inserted in and withdrawn from the casing through a smaller diameter tubing string, such as the tubing string 12, and operated to perform the casing, cutting and milling operations without removing the tubing string from the wellbore. This method saves a great deal of time in carrying out casing, cutting and removal operations.

Although preferred embodiments of the present invention have been described in detail therein, those skilled in the art will recognize that various substitutions and modifications may be made to the apparatus 20 and the method described without departing from the scope and spirit of the appended claims.

What is claimed is:

1. Apparatus for effecting sequential cutting and removal by milling of a section of well conduit and well casing wherein said well conduit is disposed in said well casing in a wellbore, said apparatus being adapted to be connected to the distal end of a tubing string for receiving pressure fluid through said tubing string, said tubing string including means for rotating said apparatus when disposed in said wellbore, said apparatus comprising:

a cutter unit including a body, a first pair of opposed cutting arms pivotally mounted on said body for movement between a retracted position and a working position for cutting through said well conduit, said first pair of cutting arms being interchangeable with a second pair of opposed milling arms which are pivotally mounted on said body in place of said first pair of cutter arms, said pair of milling arms each including cutting elements thereon for milling a downwardly-facing end of said well conduit whereby said apparatus is operable to remove a section of said well conduit by movement in a direction generally upward or out of said well conduit, said pair of milling arms being interchangeable with a second pair of opposed cutting arms operable to be pivotally mounted on said body for movement between retracted positions and a working position for cutting and milling a section of said well casing after removal of said section of well conduit, a first piston disposed in said body for moving said opposed pair of arms disposed on said body from said retracted position to a working position for cutting one of said well conduit and said well casing, a second piston disposed on said body and movable to a position for urging said opposed pair of arms into said working position and for holding said opposed pair of arms in said working position for cutting one of said well conduit and said well casing; and a first stabilizer unit connected to said cutter unit including a body and at least one pair of opposed stabilizer arms pivotally mounted on said body and movable between radially retracted and extended positions, said stabilizer arms including first bearing surfaces thereon for engagement with said well conduit for stabilizing said apparatus when said apparatus is cutting and milling said well conduit and said stabilizer arms including second bearing surfaces thereon engageable with said well casing when said apparatus is disposed in a position in said wellbore from which said well conduit has been removed; and a piston disposed on said body of said first stabilizer unit for urging said stabilizer arms to move from said retracted position to said extended positions, respectively.

2. The apparatus set forth in claim 1 including:

a second stabilizer unit connected to one of said first stabilizer unit and said cutter unit and having a pair of opposed stabilizer arms pivotally mounted thereon, said opposed stabilizer arms of said second stabilizer unit being radially extendable and retractable in a plane which intersects a plane in which the stabilizer arms of said first stabilizer unit are movable.

3. The apparatus set forth in claim 1 wherein:

said milling arms each including plural cutting elements mounted thereon, respectively, for engagement with a surface on said well conduit for milling away said well conduit to effect removal of a section thereof.

4. The apparatus set forth in claim 1 wherein:

said milling arms each include at least one radially projecting support portion for supporting a plurality of cutting elements forming cutting surfaces for milling an end of said well conduit.

5. The apparatus set forth in claim 4 wherein:

said support portion is disposed for supporting said cutting elements to cut tangentially along a cylindrical part of said well conduit.

6. The apparatus set forth in claim 4 including:

circumferentially spaced support portions on said millings arms for supporting separate sets of cutting elements for milling said conduit, said support portions forming a space therebetween for breaking chips formed by said cutting elements.

7. The apparatus set forth in claim 4 wherein:

said cutting elements comprise generally cylindrical hard metal elements supported on said arms and forming a metal cutting surface.

8. The apparatus set forth in claim 7 wherein:

said cutting elements comprise generally cylindrical members forming a circular cutting edge delimited by a chip relieving recess.

9. The apparatus set for in claim 8 wherein:

said cutting elements include a circumferential relief surface formed thereon and delimited by said cutting edge.

* * * * *